US010932642B2

(12) United States Patent
Bardo

(10) Patent No.: US 10,932,642 B2
(45) Date of Patent: Mar. 2, 2021

(54) GROOVE AND CRACK CLEANING TOOL

(71) Applicant: John Bardo, Grass Valley, CA (US)

(72) Inventor: John Bardo, Grass Valley, CA (US)

(73) Assignee: John Bardo, Grass Valley, CA (US)

( * ) Notice: Subject to any disclaimer, the term of this patent is extended or adjusted under 35 U.S.C. 154(b) by 0 days.

(21) Appl. No.: 15/926,179

(22) Filed: Mar. 20, 2018

(65) Prior Publication Data

US 2019/0290092 A1 Sep. 26, 2019

(51) Int. Cl.

| | |
|---|---|
| ***A47L 13/00*** | (2006.01) |
| ***E01H 1/00*** | (2006.01) |
| ***A47L 13/08*** | (2006.01) |
| *E01H 1/12* | (2006.01) |

(52) U.S. Cl.

CPC ..... *A47L 13/08* (2013.01); *E01H 2001/1293* (2013.01)

(58) Field of Classification Search

CPC ..... A47L 13/08; A47L 13/00; A47L 13/02; B08B 1/005; E01H 2001/1293

USPC ..... 15/236.05, 236.06, 236.01; 30/169, 172

See application file for complete search history.

(56) References Cited

U.S. PATENT DOCUMENTS

| | | | | |
|---|---|---|---|---|
| 5,471,696 | A * | 12/1995 | Linfoot | A47L 13/00 15/104.001 |
| 5,666,683 | A * | 9/1997 | Gairdner | A47L 13/08 15/104.001 |
| 2002/0189037 | A1* | 12/2002 | Lee | A47L 13/02 15/104.001 |
| 2015/0182091 | A1* | 7/2015 | Epting | A47L 13/08 15/236.07 |
| 2017/0238781 | A1* | 8/2017 | Walsh | A47L 13/08 |

* cited by examiner

*Primary Examiner* — Daniel J Colilla

(57) ABSTRACT

An improved groove and crack cleaning tool that is economical in cost to manufacture, includes a rigid blade head with a blade tip at the end of the blade edge adapted to dislodge debris build-up commonly found between outdoor surfaces. In addition, groove and crack cleaning tool has a handle adapter built into the blade head for the attachment of different types of handles. The blade head having different thickness and length provide a tool that is simple and easy to use on many outdoors surface and during tool operation, the blade edge glide will slide over the outdoor surface without causing damage to that surface. The blade head is angled to easily wedge under any debris lodged in groove or cracks forcing the lodged debris generally upward.

6 Claims, 11 Drawing Sheets

GROOVE AND CRACK CLEANING TOOL

FIELD OF THE INVENTION

The present invention relates to groove and crack cleaning tool for removing debris from the space between outdoor flooring and similar structures. More specifically, the present invention relates to improved tool for cleaning grooves between planks of decks, paver stones, bricks pathways and cracks in concrete sideway, curbs.

BACKGROUND OF THE INVENTION

Outdoor decks typically include wood or composite planks arranged in a generally parallel layout with a narrow gap or crevice between adjacent planks. The gap allows expansion space for wood planks and facilitates water drainage. This gap, however, commonly clogs with debris including leaves, pine needles, and other matter. The build-up of debris between the planks accelerates deterioration of the planks, causes the deck surface to become slippery, and inhibit its water shedding. Further, periodic maintenance of the deck, typically consisting of painting or staining, requires complete removal of the debris build-up. Thus, a need remains for a tool designed to efficiently and completely remove debris and build-up between deck planks.

People use knives, screwdrivers, or other hand tools to remove such debris. The use of such tools requires kneeling down, and is laborious and time consuming. Thus, there remains a need for deck-cleaning tool that not only adequately fits between the deck planks, but does not re-deposit the debris build-up on top of the surface of the deck. Moreover, such an improved deck-cleaning tool should eliminate a remedial cleaning operation.

Plants will grow anywhere they find water, sunlight and soil. This includes the spaces between individual pavers, stones or bricks in a patio. Plants growing in patio cracks make the area look unkempt and unsightly. If the weeds continue to grow, they may move paver blocks or cause other types of patio materials to move or crack.

Block paving offers an affordable way to create pathways or patios in your landscaping, but the individual blocks provide an opportunity for weeds to squeeze in through the cracks. Not only do the weeds look unattractive, they could cause shifting or damage to the pavers. Stopping weeds in paver areas starts with the installation of the walkway or patio. Continued maintenance to control weeds as soon as they appear prevents the unwanted greenery from taking over your block pavers.

Sidewalk cracks are generally narrow, but some allow just enough space for persistent grass or weeds to grow. Removal of the intrusive grass keeps the sidewalk looking clean and improves your landscape's appearance. Grass-control options include manual removal, chemicals and organic methods that reduce damage to surrounding plants. Starting with less-harmful methods allows you to remove the grass with the smallest impact on the environment, but stubborn grass growth may require a stronger approach.

while grass and weeds cannot grow beneath pavers, it is virtually impossible to prevent them from springing up in cracks, crevices, joints and spaces between them. If the areas are shaded and remain damp, moss often develops there, too. Unlike grass and weeds, these small plants spread across paved surfaces as well as in between. Although some gardeners enjoy the informal rustic look moss can impart, others prefer to eliminate it along with paver grass and weeds. You can easily make short work of these landscaping inconveniences with groove and crack cleaning tool.

BRIEF SUMMARY OF THE INVENTION

A primary object of the present invention is to provide a manually operated groove and crack cleaning tool for removing debris from space between deck planks, paver stones, bricks pathways, cracks in concrete sideway and curbs. This groove and crack cleaning tool digs out dirt, weeds, and debris from in between deck boards, interlocking bricks, patio stones, paving stones, garden tiles, and other crevices that are impossible to reach. Just slide the blade alongside the crevices and sweep up the material smoothly.

A groove and crack cleaning tool that in accordance with one embodiment comprises a cross-shaped tool head, having a straight elongated blade head extending to a tapered blade tip at about a 10-degree angle. The elongated blade head includes a handle adapter created when both elongated blade heads are attached and welded to form the cross-shaped tool head.

The elongated tool head including a leading edge, a back edge, a bottom edge and trailing edge, wherein the leading edge includes a non-cutting trailing edge contacting the top of the outdoor surface and the bottom edge having a concave, curved surface positioned generally along an arc having a predetermined radius from said center of said bottom edge. The leading edge of the blade head angled to a tip forcing the lodged debris generally upward.

BRIEF DESCRIPTION OF THE DRAWING

FIG. 11 is an illustrated view showing the groove and crack cleaning tool being used to remove debris from concrete sideway according to an embodiment of the present invention of

DESCRIPTION OF CERTAIN EMBODIMENT OF THE PRESENT INVENTION

In the following detailed description of the preferred embodiment, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
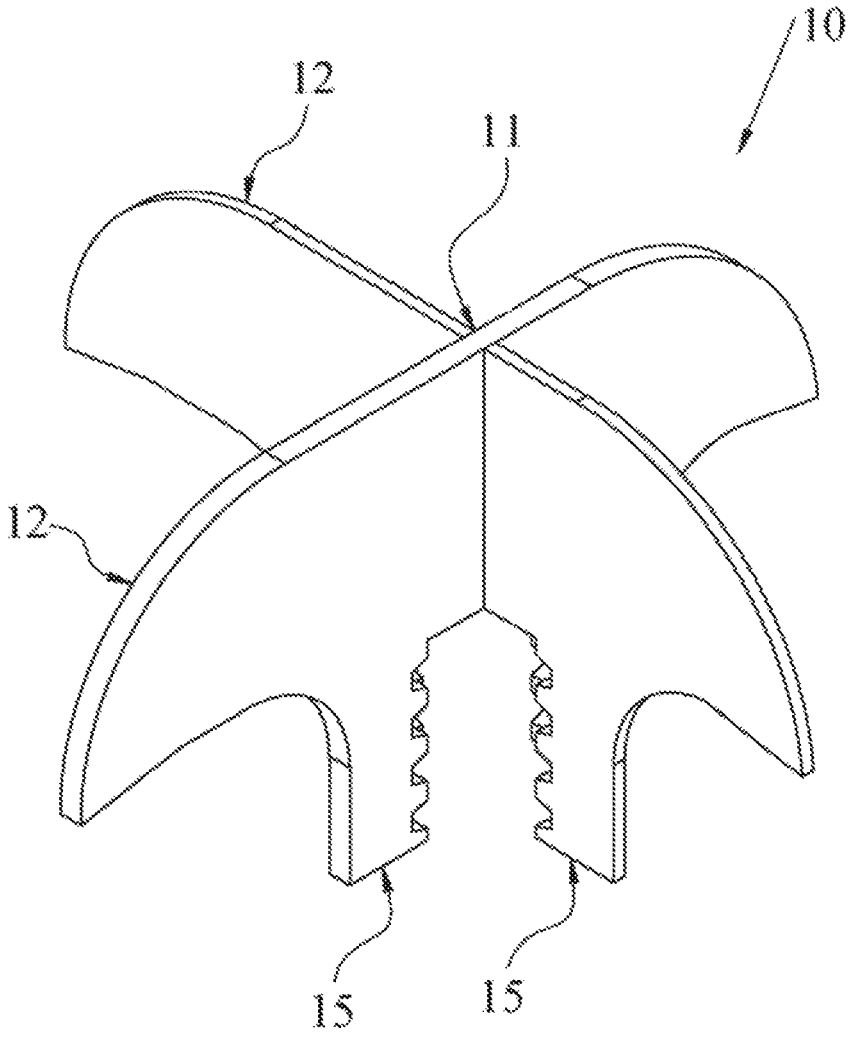
FIG. 1 is a perspective view of the groove and crack cleaning tool in accordance with the present invention.
Figure 2:
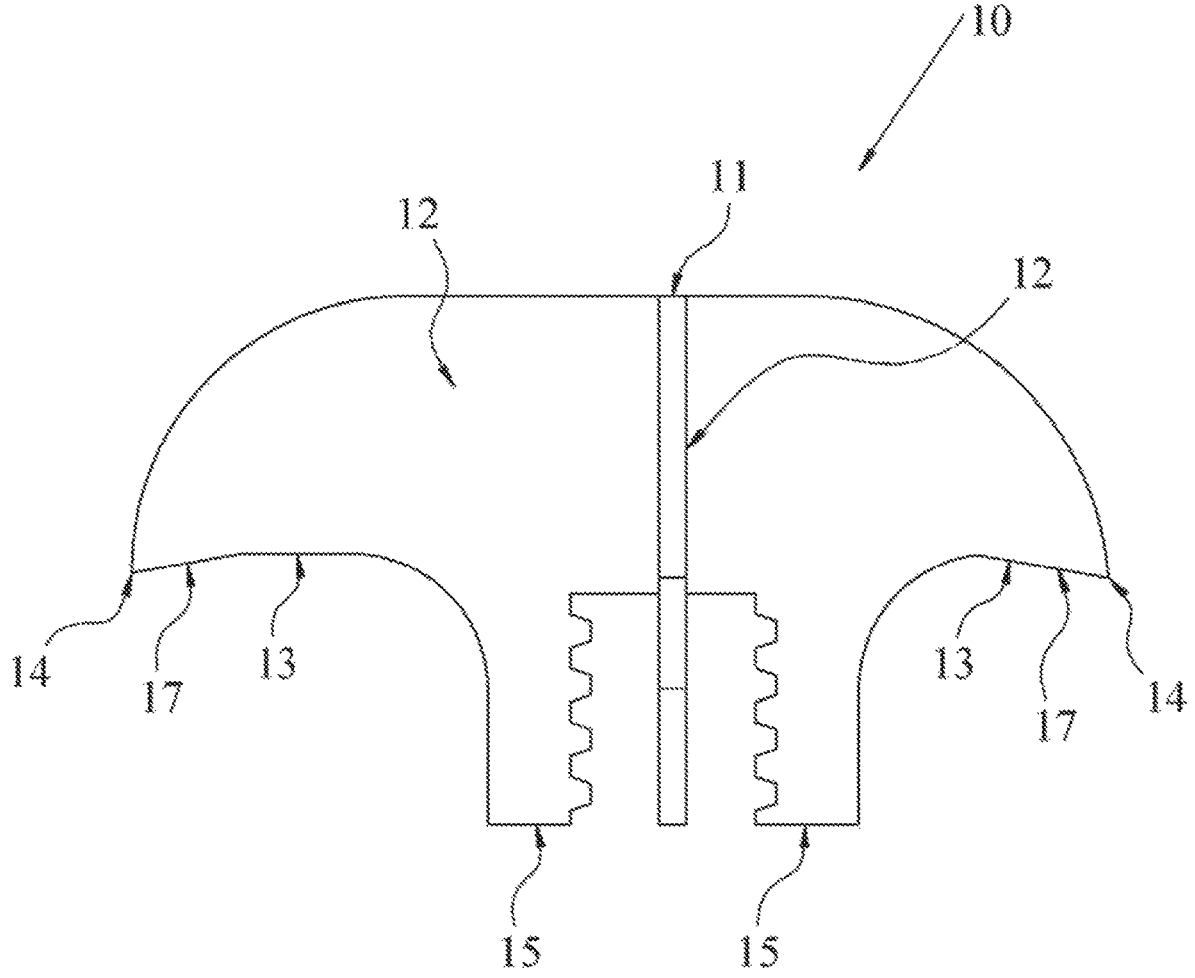
FIG. 2 is a side view of the groove and crack cleaning tool FIG. 1 with the groove head and handle adapter of the present invention.
Figure 3:
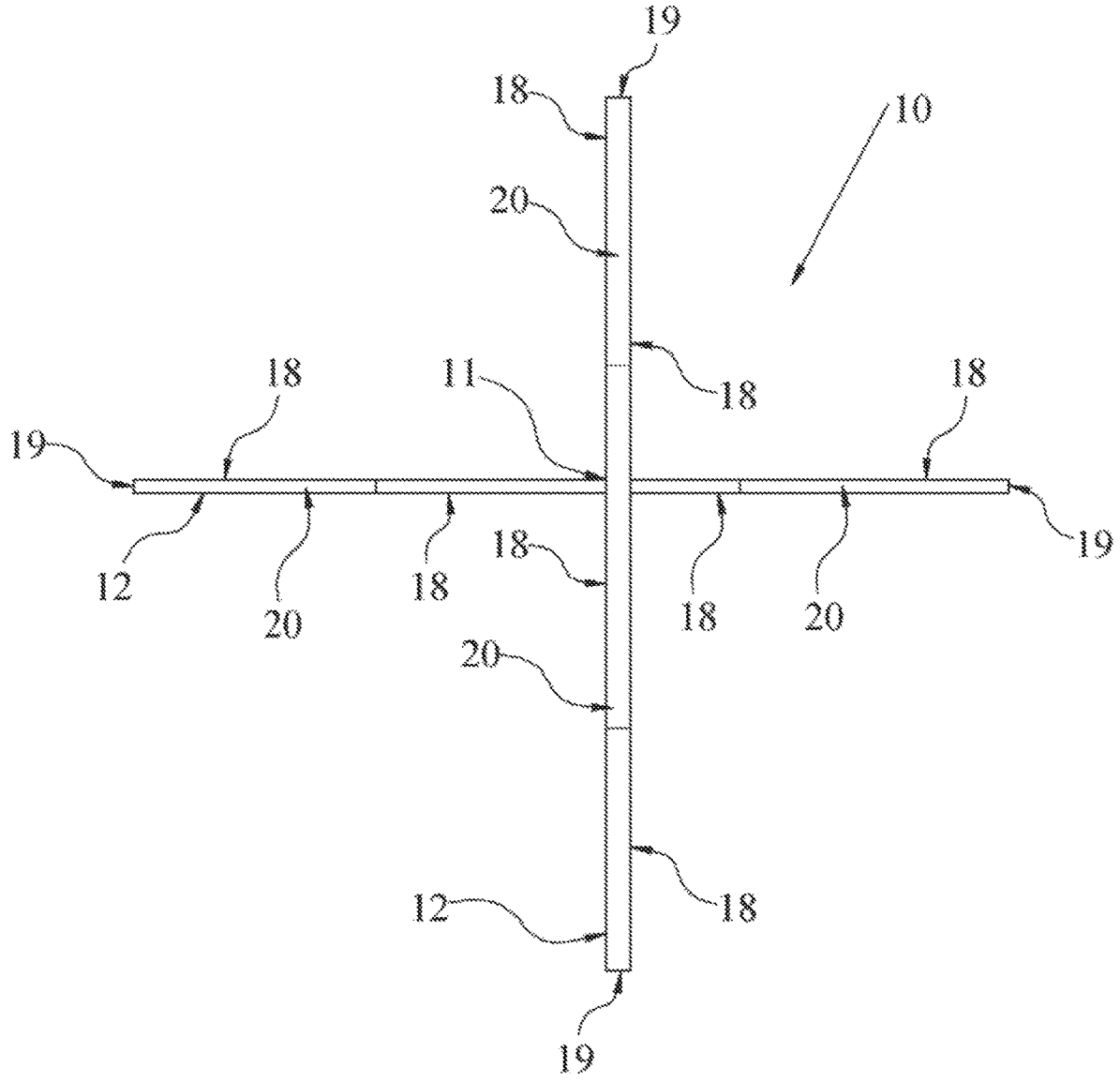
FIG. 3 is a top view of the groove and crack cleaning tool of FIG. 1 showing the dual thickness and length of the tool heads of the present invention.
Figure 4:
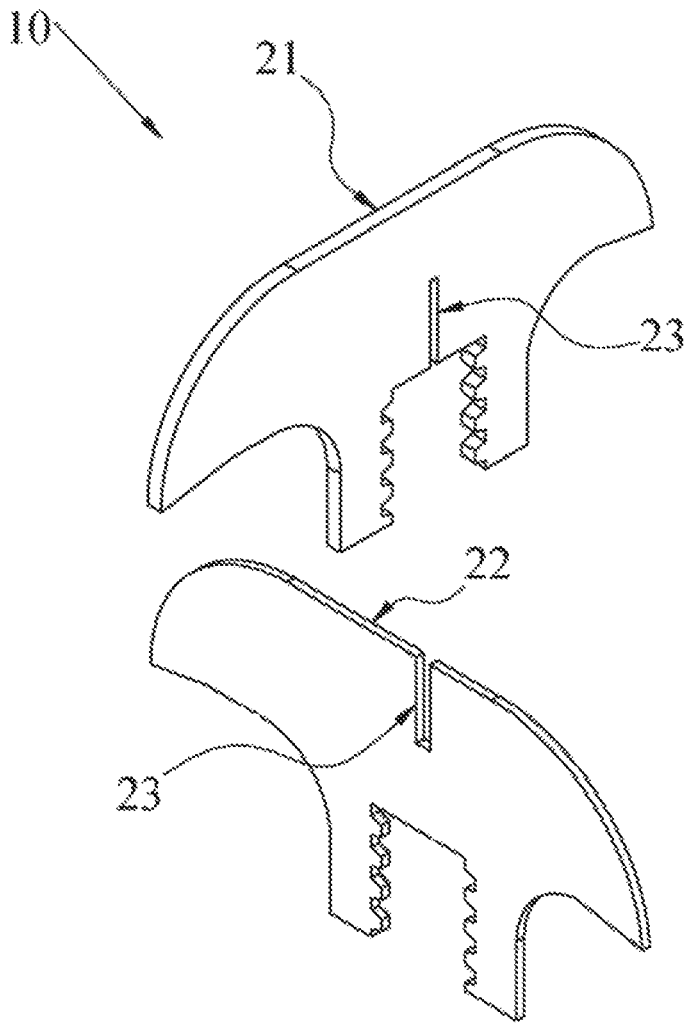
FIG. 4 is an exploded view of the relationship between components of the present invention.
Figure 5:
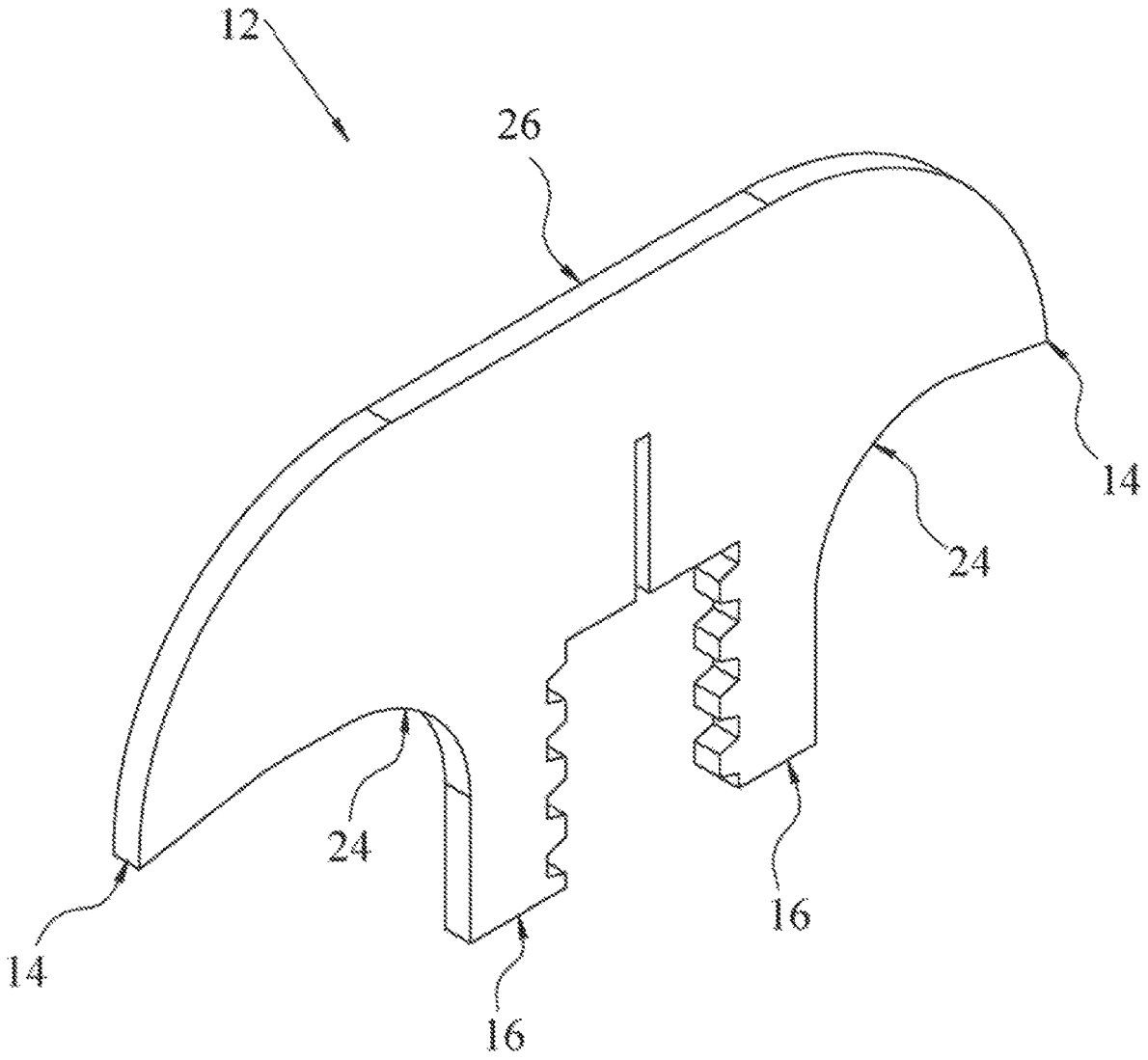
FIG. 5 is a perspective view of an elongated blade head according to an embodiment of the present invention of FIG. 1.
Figure 6:
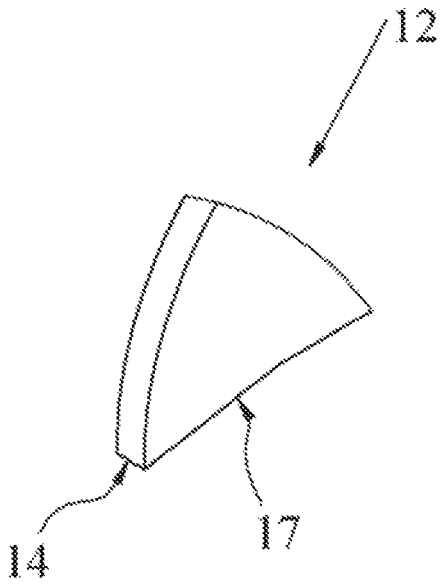
FIG. 6 is a close-up view of a elongated blade head of FIG. 5 showing the blade tip used for removal of debris.
Figure 7:
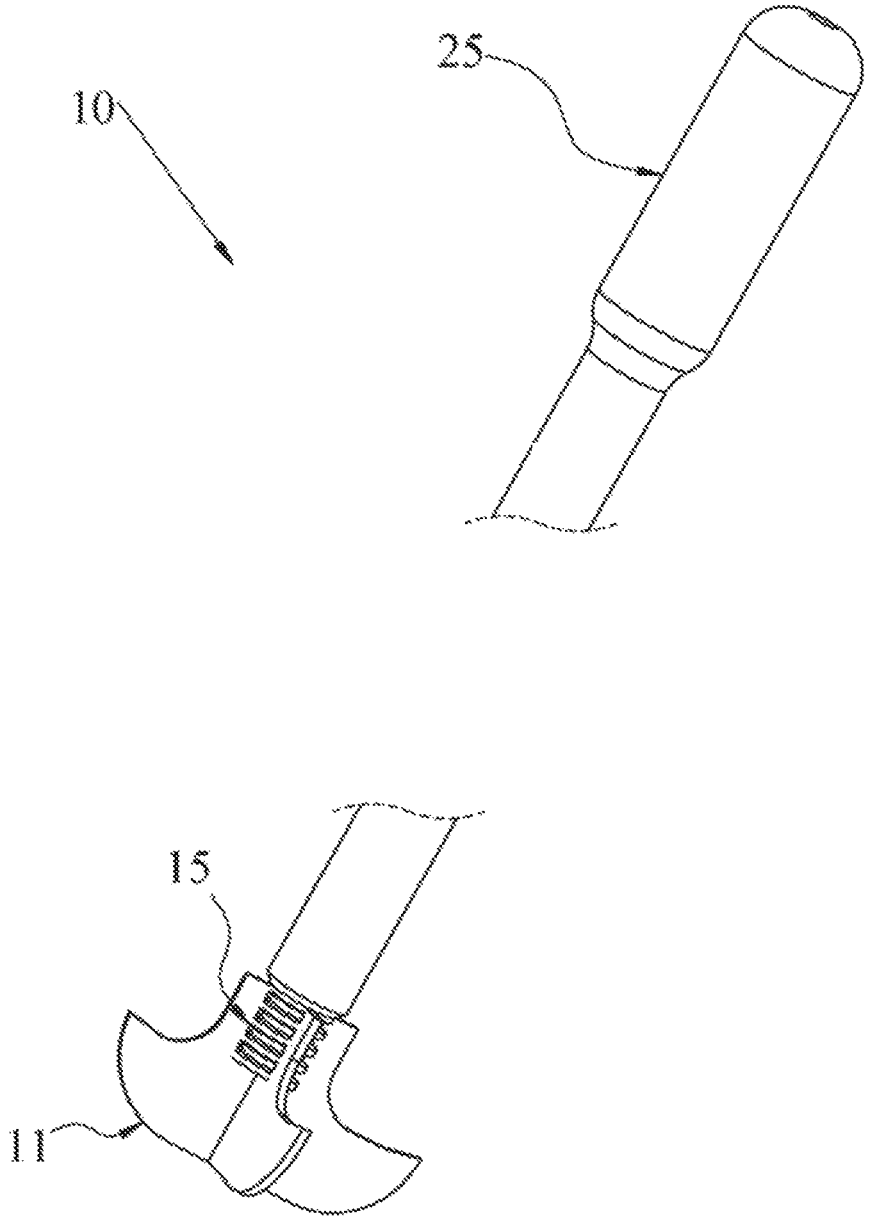
FIG. 7 is a perspective view of the groove and crack cleaning tool with the handle pole attached to the handle adapter mount of the present invention.
Figure 8:
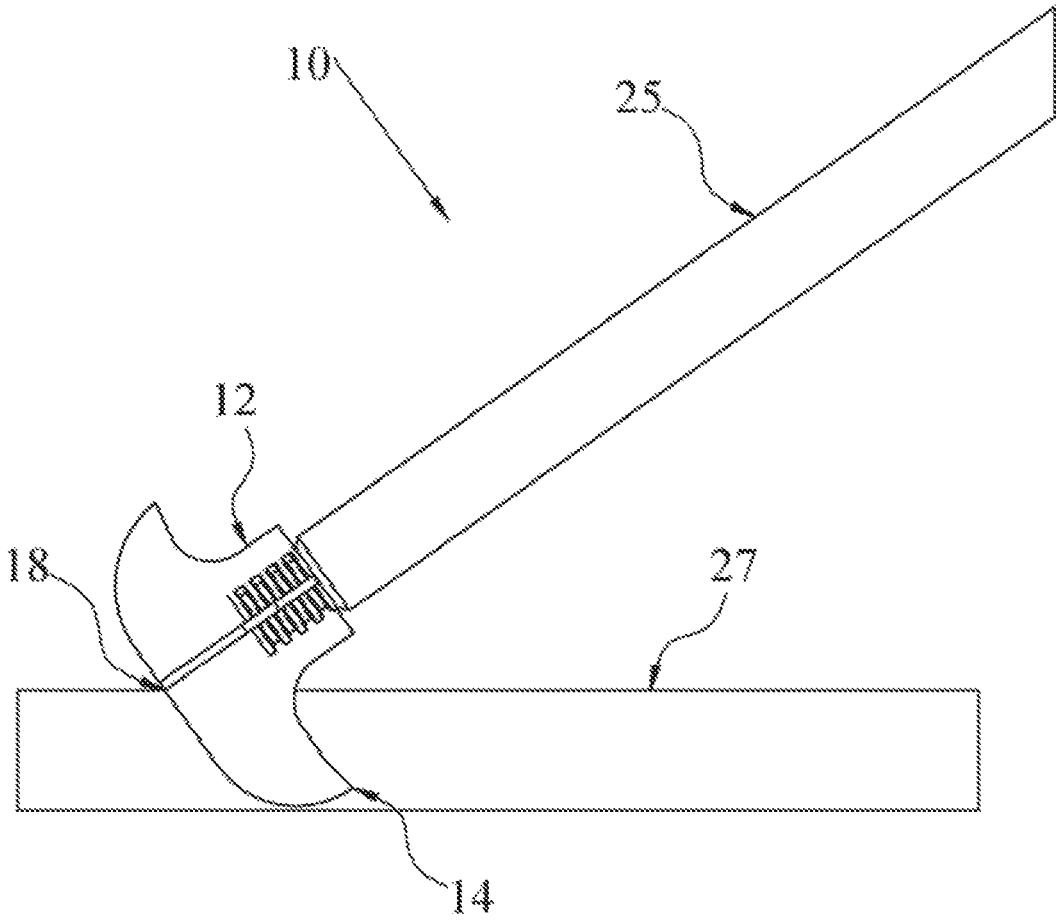
FIG. 8 is an illustrated view of the groove and crack cleaning tool with a handle attached shown in use on an outdoor surface.
Figure 9:
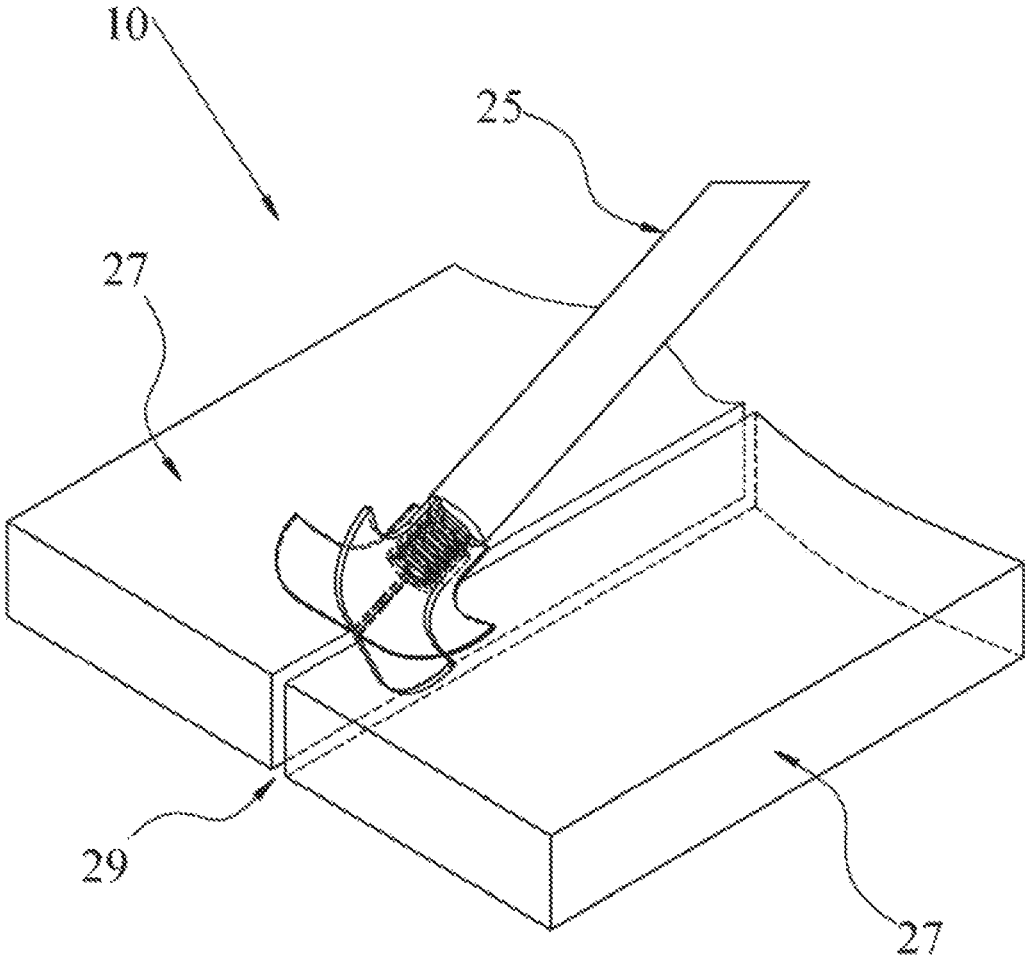
FIG. 9 is an illustrated view showing the groove and crack cleaning tool being used to remove debris from deck plank according to an embodiment of the present invention of FIG. 1.
Figure 10:
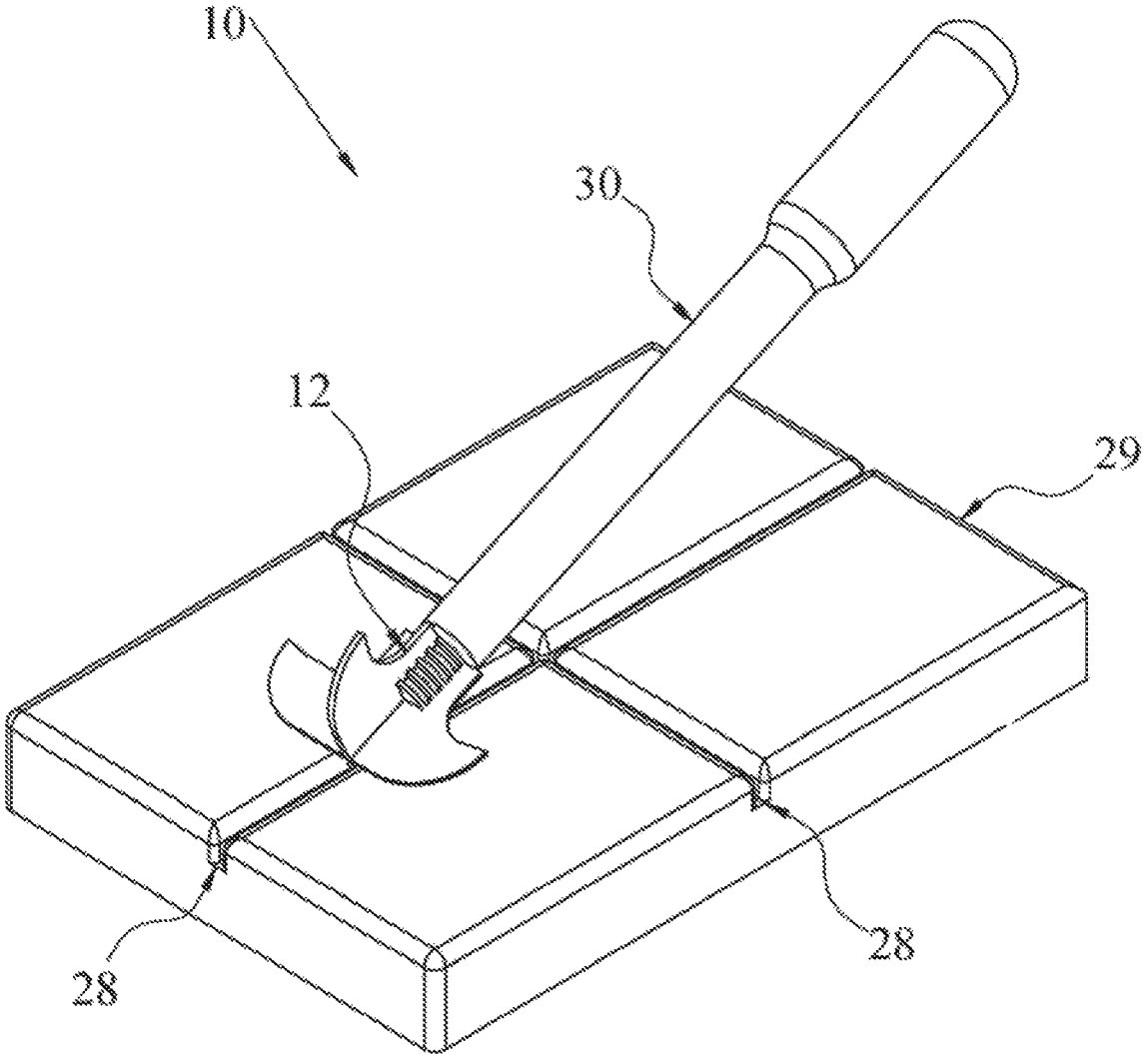
FIG. 10 is an illustrated view showing the groove and crack cleaning tool being used to remove debris from paving stone or brick pathways according to an embodiment of the present invention of FIG. 1.
Figure 11:
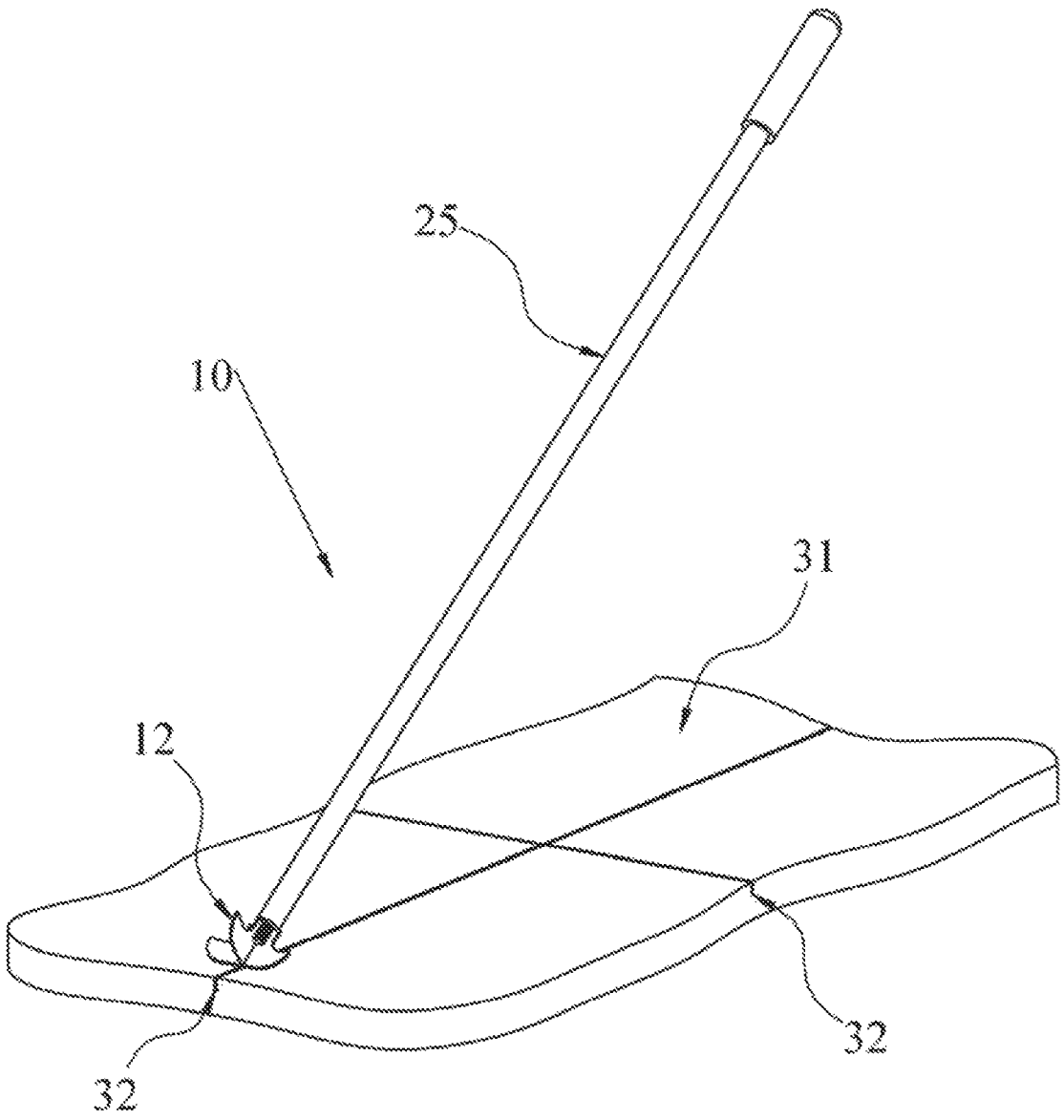

The present invention shown in FIG. 1, is a perspective view of a manually operated groove and crack cleaning tool 10 for removing debris from space between deck planks, paver stones, bricks pathways, cracks in concrete sideway and curbs, said tool comprising: A cross-shaped tool head 11 having opposing elongated blade head 12, fixed to said cross-shaped tool head 11 having a body including a handle adapter 15 created when both elongated blade heads 12 are attached to form the cross-shaped tool head 11. As generally shown in FIG. 2 is a side view groove and crack cleaning tool 10 of FIG. 1 showing said cross-shaped tool head 11 having a generally straight elongated blade head 12 adjacent said cross member extending to a tapered blade tip 14 at about a 10-degree angle 17 relative to a bottom blade edge 13. Wherein the elongated blade head 12 having threaded legs 16 included in the lower portion of the elongated blade head 12 that joined to form said handle adapter 15. As best seen in FIG. 3 is a top view of the groove and crack cleaning tool 10, of the present invention showing the different in the blade thickness 19 and lengths 20 of the cross-shaped tool head 11 more specifically the present invention may have a blade size from 0.06 to 0.10 inches wide wherein the length maybe from 1.50 to 2.00 inches long to fit between planks, stones, bricks common to most outdoor decks. In addition, elongated blade head 12, works as a trailing edge 18 parallel to outdoor flooring surface. As shown in FIG. 4, an exploded view of the groove and crack cleaning tool 10 showing the relationship between the major components including the 0.10 inch thick blade head 21 and the 0.06 inch thick blade head 22 including locking groove 23 when assembly will be welded together to form the groove and crack cleaning tool 10. FIG. 5 is a perspective view of the elongated blade head 12 comprising a generally straight flat part 26, fabricated out of a rigid metal sufficient to provide a rigid working surface, the generally straight flat part 26 including a leading edge, a back edge, a bottom edge, and trailing edge as shown in FIG. 5. The part 26 including a concaved curved bottom edge 24 to enable dislodging of debris with the protruding blade tip 14 cutting the debris from within the groove or cracks. In addition, elongated blade head 12 includes threaded legs 16 configured to receive multiple sizes handle (not shown) when assembled. Moreover, as shown in FIG. 6, is a detail perspective view of the elongated blade head 12 more specifically the blade tip 14 and 10-degree angle 17 being symmetrical along with the blade tip 14 sharpened, straight knife like edge suitable for efficiently cleaning debris such as troublesome leaves and sticks that get lodged in the tight space between the boards. As generally shown in FIG. 7 the present invention groove and crack cleaning tool 10 in accordance with one embodiment comprising a cross-shaped tool head 11 with the handle adapter 15, which may be secured to a handle 25. Handle may be any elongated pole, and is preferably as long as a standard boom handles or as short as a handheld handle. The use of the groove and crack 5 cleaning tool 10 to remove debris from the space between outdoor surface is illustrated in FIG. 8 by inserting the elongated blade head 12 into the space between planks 27. The trailing edge 18 of the elongated blade head 12 allow the tool to be pulled along an outdoor surface by the handle 25 with the forward end of the elongated blade head 12 position between the planks with the blade tip 14 extending at least to the bottom of the adjacent planks. There are various possibilities with regards to different outdoor surfaces. As illustrated in FIG. 9 one type of an outdoor surface could be outdoor decks typically include wood or composite planks arranged in a generally parallel layout with narrow gap or crevices 28 between adjacent planks. The elongated blade head 12 is angled to easily wedge under any debris lodged between planks 27 with the operator pulling the groove and crack cleaning tool 10 handle 25 parallel to the planks, the blade's angle forces the lodged debris generally upward. Outdoor surfaces may have spaced floorboard such as stone and brick 29 as illustrated in FIG. 10. Debris such as leaves, pine needle or the like, can collect on the stone and brick 29 and eventually become lodged in crevices 28 between the stone and brick 29. The present invention 10 shown with a handheld handle 30 attached to the elongated blade head 12 having the thickness less than the space between the crevices 28 along with the shorter length while not damaging the floorboard surface. Moreover as illustrated in FIG. 11, grass and weeds can push up thought crack 32 in concrete 31 from below. The present invention 10 shown with a long handle 25 attached to the elongated blade head 12 can quickly remove dirt, seeds, spores roots and debris. If such growth is not terminated it could lead to further displacement of the concrete leading to further cracking and damage to the pavement.

What is claimed is:

1. A manually operated groove and crack cleaning tool for removing debris, said tool comprising:

two tool heads, each tool head having:

a straight elongated blade extending to a tapered blade tip;

a bottom edge having a concave, curved surface positioned generally along an arc having a predetermined radius, wherein the straight elongated blade extends at an angle relative to the bottom edge of the elongated blade head;

a leading edge;

a trailing edge, wherein the leading edge of each tool head is angled to a tip for forcing lodged debris generally upward; and a locking groove, wherein the two elongated tool heads are perpendicularly attached to one another at their respective locking grooves to form a cross-shaped tool head with a handle adapter.

2. The groove and crack cleaning tool as defined in claim 1, wherein said trailing edged is tapered to a tip.

3. The groove and crack cleaning tool as defined in claim 1, wherein each said tool head length from the leading edge to the trailing edge is from 1.50 to 2.00 inches to accommodate longer and shorter outdoor surfaces.

4. The groove and crack cleaning tool as defined in claim 1, wherein said tool head thickness is from 0.06 to 0.10 inches to accommodate wider and narrower outdoor surfaces.

5. The groove and crack cleaning tool as defined in claim 1, wherein said handle adapter is configured for the attachment of different types of handles.

6. The groove and crack cleaning tool as defined in claim 1, wherein said tool heads are formed of hardened tool steel.

* * * * *